United States Patent [19]

Beduhn et al.

[11] 4,195,740

[45] Apr. 1, 1980

[54] LIFT CRANE SUPPORT SYSTEM

[75] Inventors: Daniel E. Beduhn; James G. Morrow, Sr., both of Manitowoc, Wis.

[73] Assignee: The Manitowoc Company, Inc., Manitowoc, Wis.

[21] Appl. No.: 899,230

[22] Filed: Apr. 24, 1978

Related U.S. Application Data

[63] Continuation-in-part of Ser. No. 791,312, Apr. 27, 1977, abandoned.

[51] Int. Cl.[2] ..... B66C 23/84

[52] U.S. Cl. ..... 212/66; 180/9.2 R; 212/145

[58] Field of Search ..... 212/66, 67, 68, 69, 212/145; 180/9.2 R, 9.2 C, 9.26, 6.58, 6.6

[56] References Cited

U.S. PATENT DOCUMENTS

| | | | |
|---|---|---|---|
| 726,325 | 4/1903 | Miller et al. | 212/69 X |
| 2,049,653 | 8/1936 | Ljungkull | 212/68 |
| 3,485,383 | 12/1969 | Beduhn | 212/48 |
| 3,878,944 | 4/1975 | Beduhn et al. | 212/145 |
| 4,042,115 | 8/1977 | Beduhn et al. | 212/66 X |

*Primary Examiner*—Albert J. Makay
*Assistant Examiner*—Edmond G. Rishell, Jr.
*Attorney, Agent, or Firm*—Leydig, Voit, Osann, Mayer & Holt, Ltd.

[57] ABSTRACT

A lift crane in which the upper works is mounted on a platform that rides on a large diameter ring which is fixed to a generally square, planar and rigid frame. The frame is rigidly secured directly to the cross members which interconnect the crawlers of a crawler-transporter, with the securement being releasable by pin connections to permit the ring and its frame to be removed from the crawler-transporter and used as a fixed crane mounting pad.

5 Claims, 9 Drawing Figures

LIFT CRANE SUPPORT SYSTEM

This application is a continuation-in-part of our copending application Ser. No. 791,312, filed Apr. 27, 1977, now abandoned, and the subject matter of that application is incorporated herein by reference.

The present invention relates generally to heavy lift cranes and more particularly concerns a lower or base support system for such cranes.

Conventional lift cranes include an upper body mounting the boom and machinery that rotates about a vertical axis on a lower body or base. If the crane is mobile, the lower body is, typically, crawler mounted. The lifting capacity of a mobile crane is largely determined by the geometry of the base since all of the compression and tilting loads must act through and around the base to the ground.

The constant demands for increasing crane capacity are partly met by larger sized cranes having bigger lower bodies, both for more strength and to further space the fulcrum or tipping point of the crane from the counterweight effective line of action. In U.S. Pat. No. 3,485,383 to Beduhn a system for greatly increasing crane capacity is disclosed which involves surrounding the normal crane lower body with a ring allowing a great extension of the distance between the tipping fulcrum and the counterweight line of action and a more widely distributed base for transmitting the loads to the ground. As disclosed in that patent, the system is not mobile in the sense of the base being movable when the crane is loaded. The present invention is an approach toward maintaining the capacity advantages of the ring in said patent while making the entire crane mobile, even under load.

Accordingly, it is an object of the invention to provide a crane with a lower body that is mobile and which defines a stably supported large diameter ring on which the upper works can operate.

A related object is to provide a crane as characterized above that, because a sturdy, large diameter ring is present, allows the upper works to assume an economical, versatile platform configuration designed to function on a large stable ring.

Another object is to provide a crane of the above type that readily permits the base ring to be disassociated from its transporter structure, whereupon it can be used as the base for a stationary or fixed crane mount.

Other objects and advantages of the invention will become apparent on consideration of the following description and references to the drawings, in which:

While the invention will be described in connection with a preferred embodiment, it will be understood that we do not intend to limit the invention to that embodiment. On the contrary, we intend to cover all alternatives, modifications, and equivalents as may be included within the spirit and scope of the invention as defined by the appended claims.

DESCRIPTION OF THE INVENTION

Figure 1:
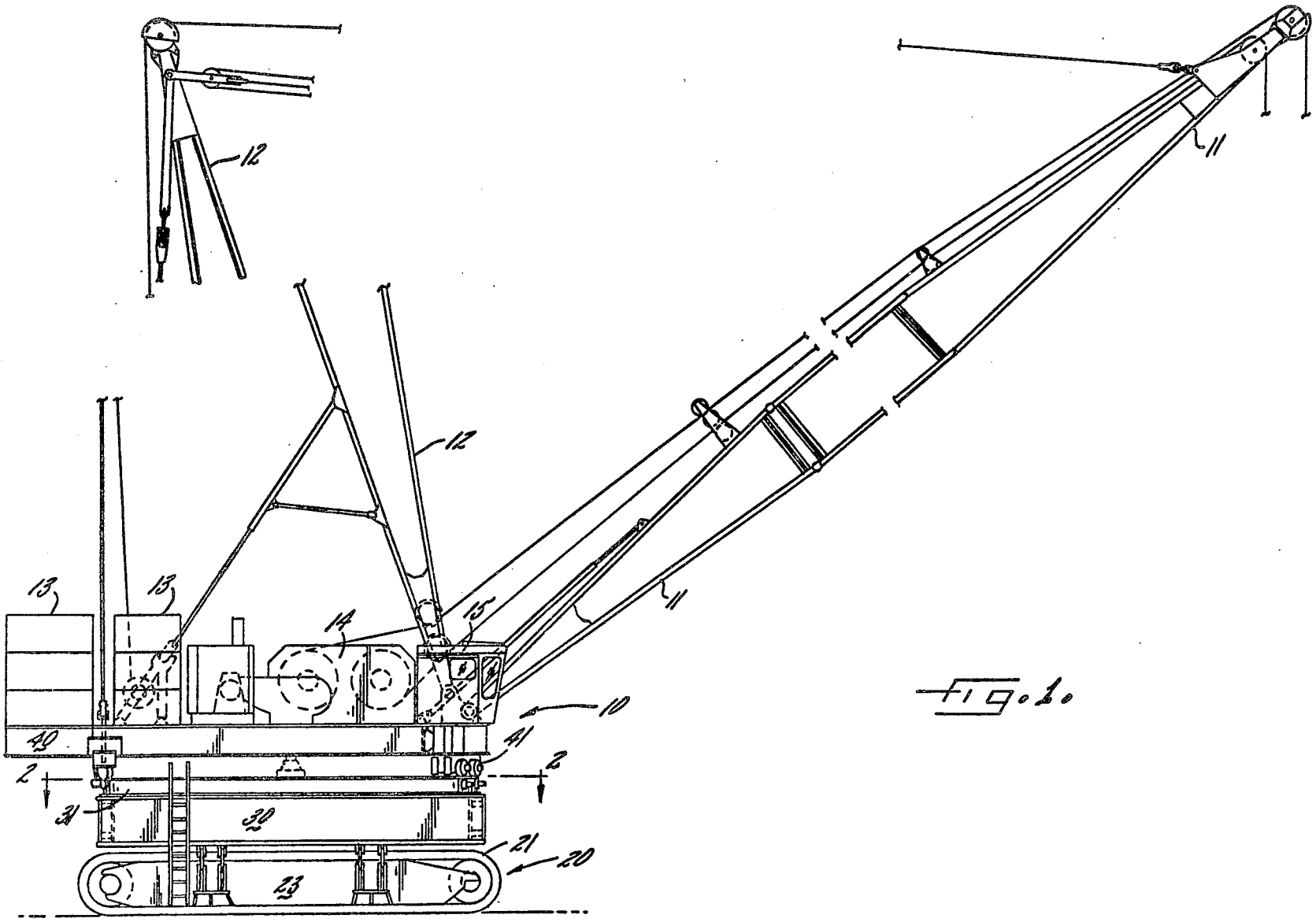
FIG. 1 is a side elevation of a crane embodying the present invention.

Turning to the drawings, there is shown in FIG. 1 a crane 10 embodying the invention and including an upper works including a boom 11, a mast 12, counterweight elements 13, hoist machinery 14 and an operator's module 15. The lower works of the crane 10 includes a transporter 20, preferably of the kind shown in U.S. Pat. No. 4,000,784, which is made up of a pair of parallel crawlers 21 interconnected by a body 22 (see FIG. 4) supporting a drive mechanism for the crawlers including a power plant (not shown). Each of the crawlers 21 is trained to encircle a rigid longitudinal side frame member 23 and the side frames are interconnected by a pair of large cross beams 24 which are preferably pin connected to the body 22 as shown in U.S. Pat. No. 4,000,784.

Figure 2:
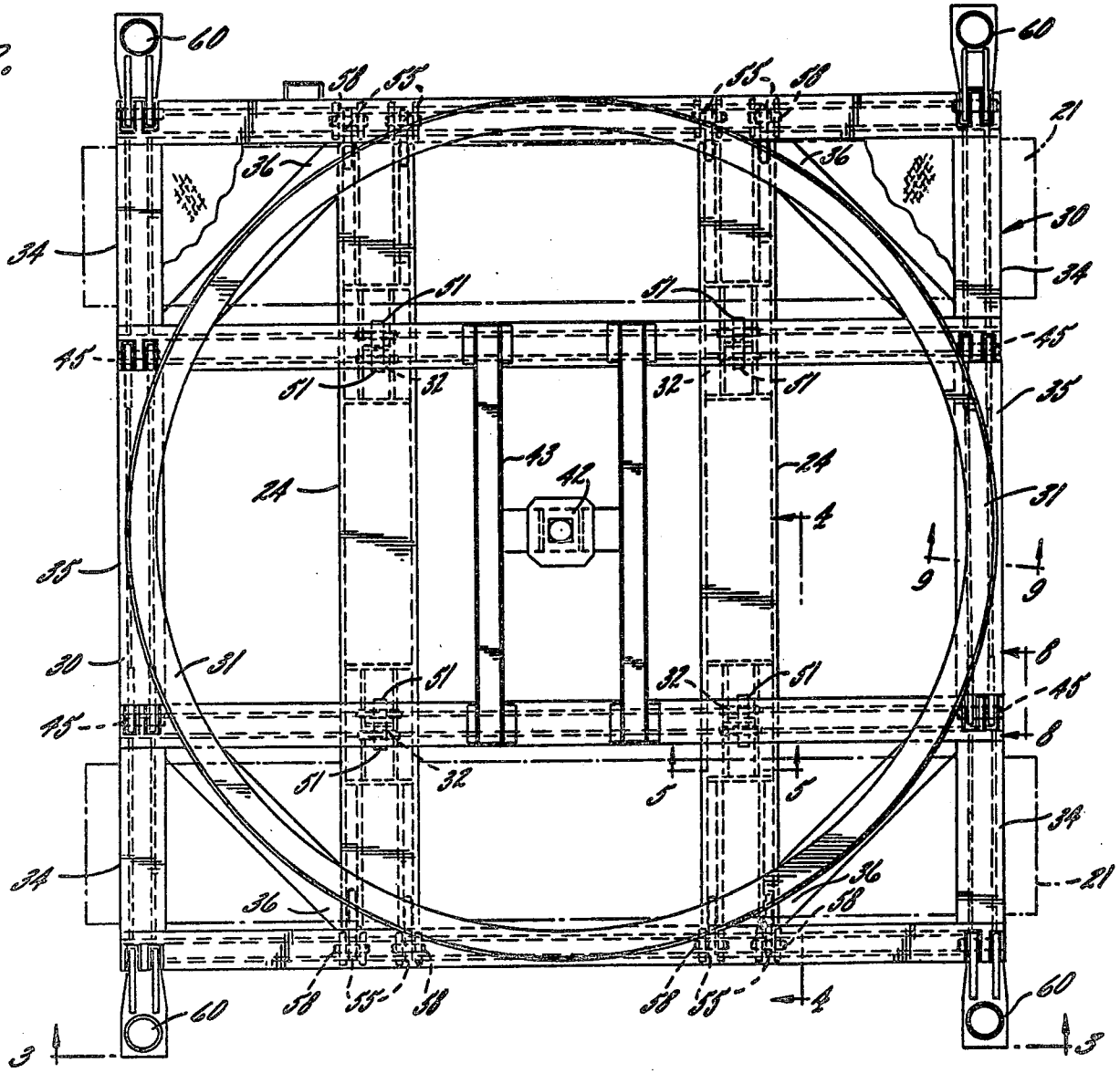
FIG. 2 is a section taken substantially along line 2—2 of FIG. 1.

In accordance with the invention, a generally planar and square, open frame 30 mounts a ring 31 defining a track for the upper works, and the frame 30 is rigidly and directly connected to the transporter cross beams 24 by a plurality of depending lugs 32,33. As illustrated in FIG. 2, the frame 30 comprises a pair of rectangular sub-frames 34, which straddle the crawlers 21, and which are connected together by end beams 35. Corner beams 36 both rigidify the sub-frames 34 and provide a continuous support for the ring 31.

Preferably, the depending lugs 32,33 on the sub-frame elements 34 are pinned to the transporter cross beams 24 so that, if desired, the transporter 20 can be disassociated from the rest of the crane assembly, whereupon the frame 30 becomes the base for a fixed type of crane mount.

Since the upper works cooperates with the large diameter ring 31, the upper works elements are mounted on a simple platform 40 provided with rollers 41 by riding on the ring 31. The platform 40 is held centered by a kingpin structure 42 mounted on an H-frame 43 which centrally interconnects the sub-frame 34. Preferably, swinging rotation of the upper works is accomplished by utilizing a drive mechanism (not shown) of the type disclosed in U.S. Pat. No. 4,013,174. Those familiar with this art will recognize that the crane 10 is a simple, and hence relatively inexpensive, high capacity lift crane of great versatility.

Figure 3A:
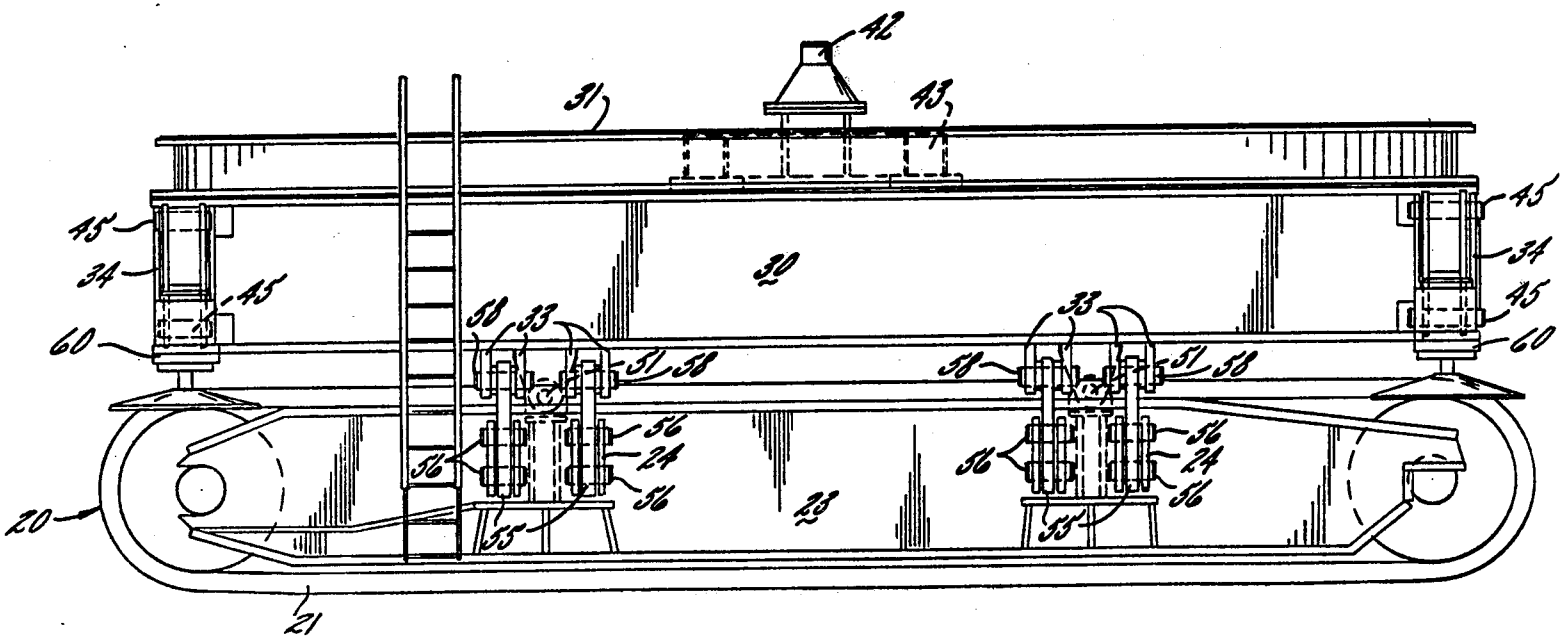
FIG. 3 is a section taken substantially along line 3—3 in FIG. 2.
Figure 4:
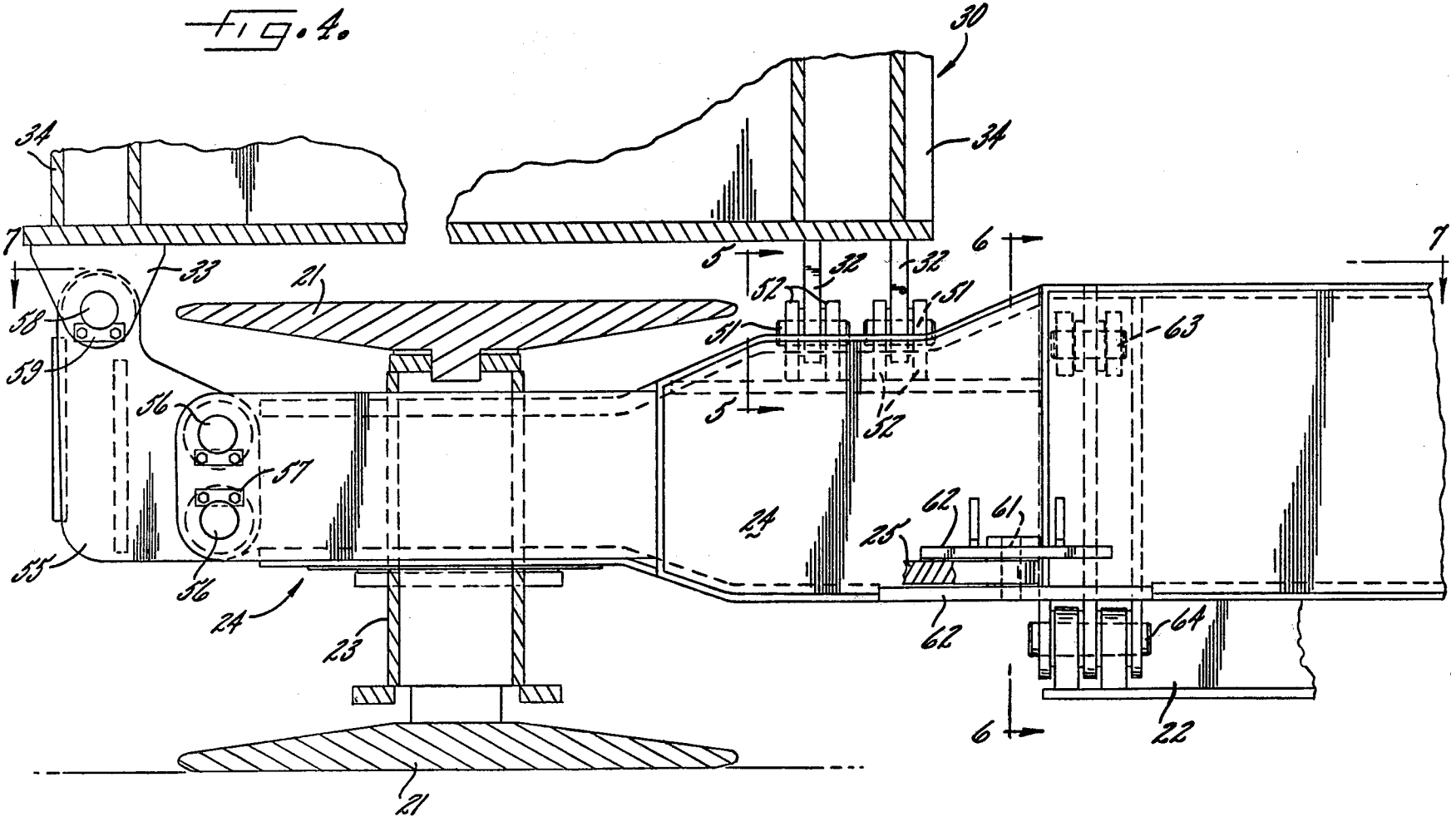
FIG. 4 is an enlarged, fragmentary section taken substantially along line 4—4 in FIG. 2.
Figure 6:
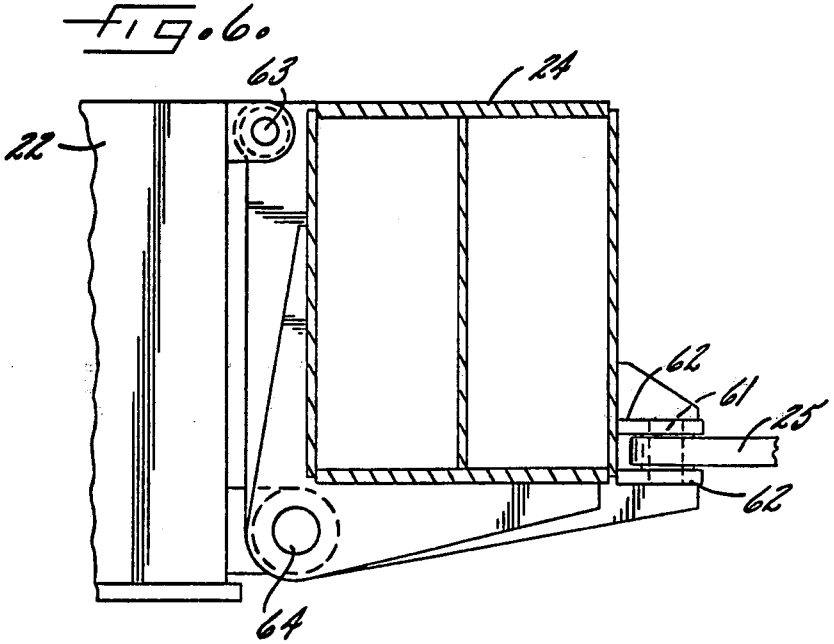
FIGS. 5, 6 and 7 are enlarged, fragmentary sections, respectively, taken substantially along lines 5—5, 6—6 and 7—7 in FIG. 4 and, FIGS. 8 and 9 are enlarged, fragmentary sections, respectively, taken substantially along lines 8—8 and 9—9 in FIG. 2.
Figure 9:
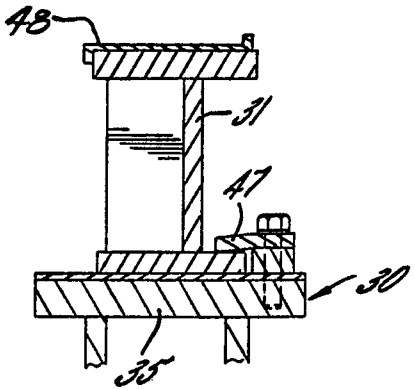
Figure 5:
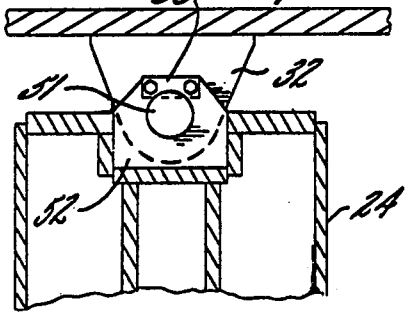
Figure 8:
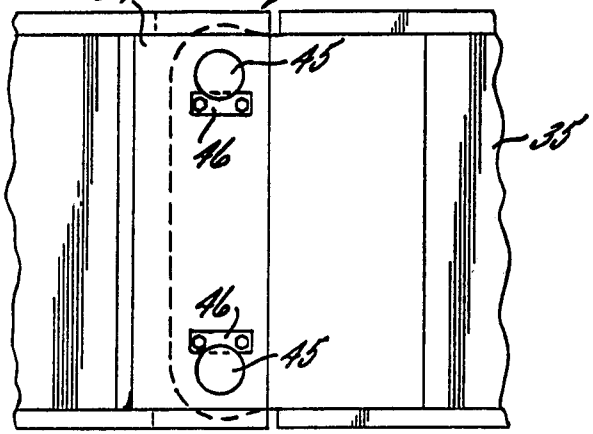
Figure 7:
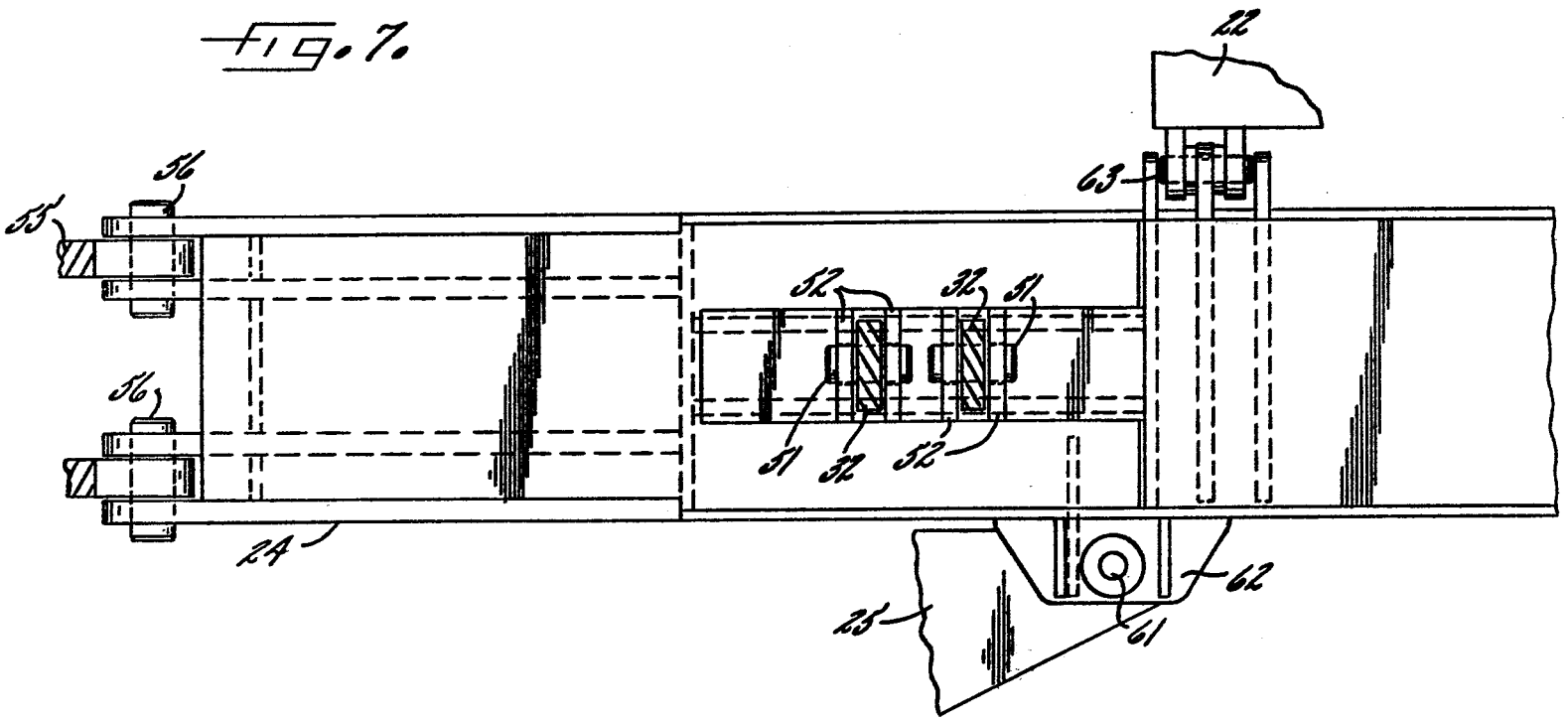

Turning now to FIGS. 3-5 the pin interconnections between the frame 30 and the transporter cross beams 24 may be more clearly seen. Also, in FIGS. 6 and 7 the pin connections between the cross beams 24 and the car body 22 of the transporter 20 and the pin connections between the cross beams 24 and webs 25 projecting inwardly from the crawler side frames 23 are shown. FIG. 8 shows pins 45 interconnecting one of the inner ends of the sub-frame 34 and the end beam 35 with the pins locked in place by plates 46 inserted in slots in the pins 45 and bolted to the face of the sub-frame 34. FIG. 9 shows a cross-section through the ring 31 in the form of an I-beam which is secured to the frame 30 by a plurality of clamps 47. The ring 31 has an upper wear surface 48 on which the rollers 41 ride.

As shown in FIGS. 2–5, the inner lugs 32 on the sub-frames 34 are connected by pins 51 inserted in aperatures formed in pairs of upstanding lugs 52 on the upper surface of the cross beams 24. Preferably, the pins 51 are held in place by lock plates 53 insertd in slots in the ends of the pins 51 and bolted on the face of the lugs 52. Pursuant to the invention, the outer ends of the cross beams 24 extend through the side frames 23 and mounting yokes 55 are connected to the beams 24 by pins 56 held in place by lock plates 57. The mounting yokes 55 are generally L-shaped and, through pins 58 inserted through aperatures in the lugs 33, interconnect the outer ends of the sub-frames 34 to the outer ends of the cross beams 24. The pins 58 are preferably held in place by lock plates 59 bolted to the face of the lugs 33.

When it is desired to remove the frame 30 from the transporter 20 it is only necessary to remove the lock plates 53 and 59 and withdraw the connecting pins 51 and 58. To facilitate removal, the frame 30 preferably carries four hydraulic jacks 60 mounted at its corners outboard of the crawlers 21. Once the pins 51,58 are removed and the frame 30 raised slightly by the jacks 60, the crawler-transporter can be driven out from under the frame 30. It will be appreciated, of course, that the jacks 60 may also be used to facilitate leveling and blocking up the frame 30 for use as a fixed or stationary crane mount.

As mentioned above, the cross beams are preferably connected to the webs 25 of the crawler side frames 23 by pins 61 which pass through suitable lugs 62 on the cross beams 24. (See FIGS. 6 and 7). The cross beams 24 are also pin connected to the central car body 22 of the transporter 20 by upper and lower pins 63 and 64 in the manner taught in U.S. Pat. No. 4,000,784. If desired, these pins may be inserted and withdrawn by hydraulic actuators. Thus, the transporter 20 may also be quickly disassembled for shipment to another site.

We claim as our invention:

1. The combination comprising, a generally planar and square, rigid frame, a circular track-defining ring mounted on the upper surface of said frame, a transporter assembly including a pair of parallel crawlers interconnected by a body and a pair of rigid cross beams, each of said crawlers is trained to encircle a rigid longitudinal member, a plurality of connecting elements rigidly interconnecting said frame and said cross beams both inboard and outboard of said crawlers, and an upper works supporting platform mounted for rotation on said ring.

2. The combination of claim 1 in which said connecting elements receive pins to releasably interconnect said frame and said cross beams so that the frame can be removed from the transporter to form a fixed crane mounting ring.

3. The combination of claim 1 in which said cross beams extend through said longitudinal members and carry a yoke at each end said yoke being pin connected to said frame.

4. The combination of claim 1 in which said square rigid frame includes a pair of rigid sub-frames each of which straddles one of said crawlers and said sub-frames are connected together in spaced apart relation by end frames pin connected thereto.

5. The combination of claim 1 in which said square rigid frame carries jack means adjacent its corners outboard of said crawlers for raising said frame so that said transporter may be installed and removed.

* * * * *